US007705574B2

(12) United States Patent
Fox

(10) Patent No.: US 7,705,574 B2
(45) Date of Patent: Apr. 27, 2010

(54) REMOTE POWER CONTROLLER WITH POWER SHARING CIRCUIT

(75) Inventor: David A. Fox, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 209 days.

(21) Appl. No.: 12/138,464

(22) Filed: Jun. 13, 2008

(65) Prior Publication Data

US 2009/0309560 A1 Dec. 17, 2009

(51) Int. Cl.
*G05F 1/573* (2006.01)

(52) U.S. Cl. ..... 323/277; 323/268; 361/93.9

(58) Field of Classification Search ..... 323/268, 323/269, 272, 273, 274, 276, 277, 350; 361/87, 361/93.9

See application file for complete search history.

(56) References Cited

U.S. PATENT DOCUMENTS 4,644,247 A * 2/1987 Burmenko ..... 320/138
6,249,110 B1 * 6/2001 Geyer et al. ..... 323/272
6,288,523 B2 * 9/2001 Antoszkiewicz ..... 323/267
7,292,015 B2 * 11/2007 Oswald et al. ..... 323/268

* cited by examiner

*Primary Examiner*—Gary L Laxton
(74) *Attorney, Agent, or Firm*—Stephen G. Mican

(57) ABSTRACT

A direct current (DC) remote power controller for remotely controlling DC power between a DC power source and a DC load, comprises: a current sensor for sensing the level of current that the power source supplies to the load and generating a current feedback signal representative of the sensed current level; a current limit controller that compares the current feedback signal to a reference current level and generates a current regulation signal representative of the value of sensed current level above the reference current level; a current limiting device that is responsive to the current regulation signal to limit load current to the reference current level up to a first predetermined level of potential difference across the current limiting device; a load resistance; and a switched-mode DC-to-DC converter in parallel with the current limiting device that senses potential difference across the current limiting device and diverts a portion of the load current from the current limiting device through the load resistance above the first predetermined level of potential difference to reduce power dissipation of the current limiting device and maintain the load current at the reference current level.

25 Claims, 1 Drawing Sheet

REMOTE POWER CONTROLLER WITH POWER SHARING CIRCUIT

FIELD OF THE INVENTION

The invention relates to power control circuitry, and more particularly to power sharing circuitry for a remote power controller.

BACKGROUND OF THE INVENTION

A remote power controller (RPC) is a form of switching circuitry that offers remote switching of a high power electrical load from its source with a low power control signal bus. RPCs are particularly useful in aerospace applications to reduce weight, bulk, cost and power loss associated with high power remote power switching, which type of switching requires advanced features including an overload trip function, status outputs, and, often, current limiting.

Current limiting provides control of excessive currents in electrical systems when the outputs experience a fault condition. RPCs limit load current by controlling the load current to some value in excess of normal value whilst sustaining the electrical potential difference between the power source and the load. A short in the load circuit maximises power dissipation in the RPC, since the full electrical potential difference of the power source voltage then exists across the RPC.

Since RPCs have semiconductor-based current limiting devices, these devices must dissipate significant amounts of power. Since some applications may require the dissipation of hundreds of watts, RPCs may require tens of semiconductor-based current limiting devices to operate in parallel to achieve such power dissipation. Certain RPC designs have used so-called "helper" circuits that divert some of the load current to a resistor under fault conditions, reducing power dissipation for the semiconductor-based current limiting devices. Under ideal conditions, the "helper" circuit can reduce the power in the semiconductor-based current limiting devices by 75 percent. With practical tolerances, the power reduction is less than 60 percent at best.

SUMMARY OF THE INVENTION

The invention generally comprises a direct current (DC) remote power controller for remotely controlling DC power between a DC power source and a DC load, comprising: a current sensor for sensing the level of current that the power source supplies to the load and generating a current feedback signal representative of the sensed current level; a current limit controller that compares the current feedback signal to a reference current level and generates a current regulation signal representative of the value of sensed current level above the reference current level; a current limiting device that is responsive to the current regulation signal to limit load current to the reference current level up to a first predetermined level of potential difference across the current limiting device; a load resistance; and a switched-mode DC-to-DC converter in parallel with the current limiting device that senses potential difference across the current limiting device and diverts a portion of the load current from the current limiting device through the load resistance above the first predetermined level of potential difference to reduce power dissipation of the current limiting device and maintain the load current at the reference current level.

DETAILED DESCRIPTION OF THE INVENTION

Figure 1:
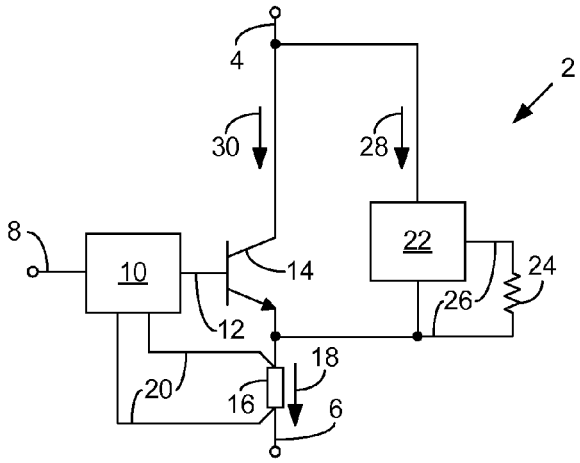
FIG. 1 is a high-level schematic diagram of one possible embodiment of the invention.

FIG. 1 is a high-level schematic diagram of a DC RPC 2 according to one possible embodiment of the invention. The RPC 2 has a power input line 4 that receives DC power from a DC power source (not shown) and a power output line 6 that supplies DC power to a controlled DC load (not shown). The RPC also has a control input line 8 that receives a control signal from a remote control unit (not shown).

A current limit controller 10 receives the control signal on the control input line 8 and generates a current regulation signal on a controller output line 12. A current limiting device 14 receives the current regulation signal on the controller output line 12 and DC power from the power source on the power input line 4. In response to the current regulation signal on the controller output line 12, the current limiting device 14 transfers DC power on the power input line 4 to the controlled load by way of the power output line 6. FIG. 1 shows the current limiting device 14 as a single NPN bipolar transistor by way of example only. The current limiting device 14 may be any sort of current limiting device, but preferably a semiconductor device or multiple semiconductor devices in parallel, such as NPN or PNP bipolar transistors, any type of field effect transistors, or insulated gate bipolar transistors, with suitable power ratings for the purpose.

A current sensor 16 inserted in or proximate the power output line 6 measures the level of current that passes through the power output line 6 to the controlled load, as represented by arrow 18, and generates a current feedback signal across feedback signal lines 20 that is representative of the sensed level. FIG. 1 shows the current sensor 16 as a resistance inserted in the power output line 6 that generates the current feedback signal as a potential difference across the resistance by way of example only. Alternatively, the current sensor 16 could be another type of sensor or arrangement, such as a resistance inserted in the power input line 4 or a Hall Effect sensor proximate the power input line 4 or the power output line 6.

The current limit controller 10 receives the current feedback signal across the feedback signal lines 20, compares the sensed level of current that the current feedback signal represents to a reference current level, and changes the level of the current regulation signal in response to any difference between them. The current limiting device 14 then changes the level of current that passes through the power output line 6 to match the reference current level.

If some sort of electrical short or fault occurs in the power output line 6 or controlled load such that the effective load resistance changes to an abnormally low value, the current limiting device 14 will attempt to limit current passing through the power output line 6 to the reference current level. This decrease in load resistance will cause a proportionate increase in potential difference across the current limiting device 14, resulting in increased power dissipation by the current limiting device 14.

To avoid power dissipation by the current limiting device 14 exceeding its limits, a switched-mode DC-to-DC converter 22 coupled across the current limiting device 14 senses the potential difference across the current limiting device 14 and when it reaches a first predetermined level, such as a level that represents the maximum power dissipation rating of the current limiting device 14, it diverts a portion of the controlled load current 18 to a load resistance 24 by way of converter output lines 26. In this way, the current passing through the switched-mode DC-to-DC converter 22, as represented by arrow 28, reduces the current passing through the current limiting device 14, as represented by arrow 30. The sum of the currents 28 and 30 equal the controlled load current 18.

In this way, the switched-mode DC-to-DC converter 22 reduces power dissipation of the current limiting device 14 whilst maintaining the load current at the reference current level. Preferably, the switched-mode DC-to-DC converter 22 diverts a portion of the controlled load current 18 that increases in proportion to the increase in potential difference across the current limiting device between the first predetermined level of potential difference and a higher second predetermined level of potential difference and then it diverts a fixed portion of the controlled load current 18 above the second predetermined level of potential difference. The switched-mode DC-to-DC converter 22 changes the amount of load current that it diverts by controlling its duty cycle.

In the simplest possible embodiment of the invention, the switched-mode DC-to-DC converter 22 may be of the step-down (Buck) or step-up (Boost) type. When the converter 22 is of the step-down type, the load resistance 24 should have a value that keeps the potential difference across the load resistance 24 on the converter output lines 26 below the potential difference across the current limiting device 14. When the converter 22 is of the step-up type, the load resistance 24 should have a value that keeps the potential difference across the load resistance 24 on the converter output lines 26 above the potential difference across the current limiting device 14. If the switched-mode DC-to-DC converter 22 comprises a transformer-isolated converter with transformer isolation between its source and load, there are no limitations on the selection of the load resistance 24.

Figure 2:
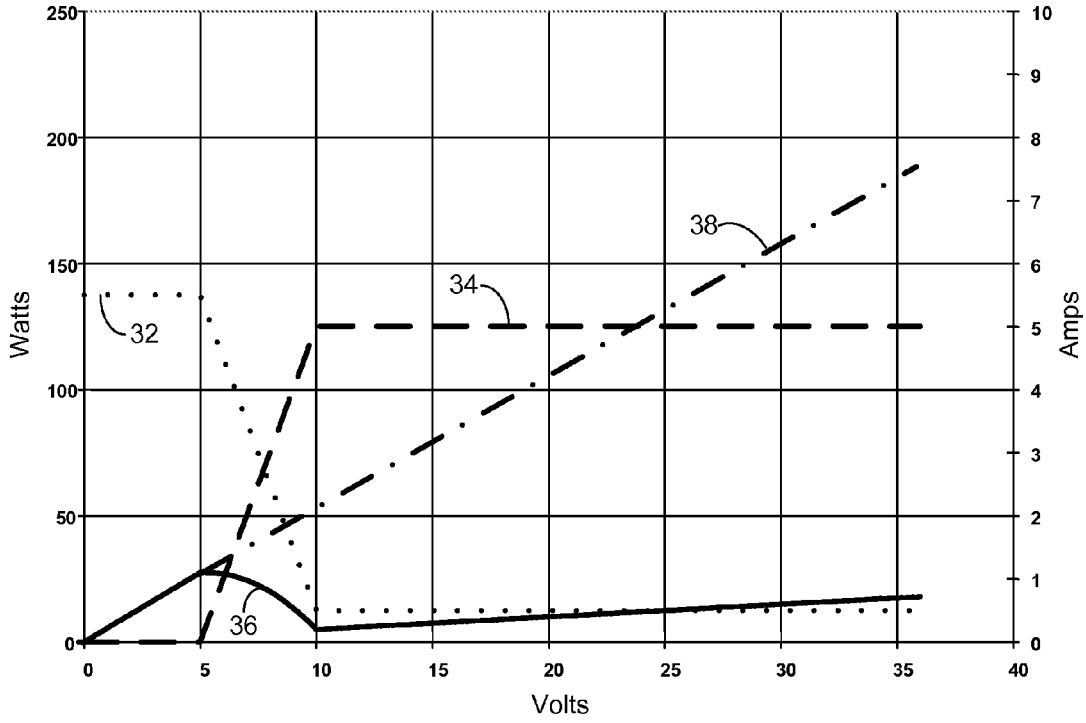
FIG. 2 is a graphical representation of the current control and power dissipation of the possible embodiment of the invention shown in FIG. 1.

FIG. 2 is a graphical representation of the current control and power dissipation of the RPC 2 according to a possible embodiment of the invention as shown in FIG. 1 for one set of selected values of reference current level, first predetermined potential difference level and second potential difference level. In this case, the reference current level is 5.5 A, the first predetermined potential difference level is 5 V and the second potential difference level is 10 V. Curve 32 represents current limiting device current 30 as a function of potential difference across the current limiting device 14. Curve 34 represents DC-to-DC converter input current 28 as a function of potential difference across the current limiting device 14. Curve 36 represents power dissipation by the current limiting device 14 as a function of potential difference across the current limiting device 14. Curve 38 represents power dissipation of the complete RPC 2. Curve 38 also represents the power that the current limiting device 14 would without power sharing according to a possible embodiment of the invention as shown in FIG. 1.

The DC-to-DC converter 22 does not begin to divert current from the current limiting device 14 up to the first predetermined potential difference level of 5 V, at which point the current limiting device 14 dissipates a maximum power of 5.5 A×5 V=27.5 W. Between the first predetermined potential difference level of 5 V and the second potential difference level of 10 V, the DC-to-DC converter 22 diverts a proportionally increasing amount of current from 0 A at 5 V to 5 A at 10 V and a fixed level of 5 A above 10 V. Therefore, the current limiting device 14 dissipates only 0.5 A×10 V=0.5 W with a potential difference of 10 V across the current limiting device 14 and only 0.5 A×35 V=17.5 W with a potential difference of 35 V across the current limiting device 14. The total power dissipated in the RPC 2 is 5.5 A×35V=198 W with 35V across the current limiting device 14.

The described embodiments of the invention are only some illustrative implementations of the invention wherein changes and substitutions of the various parts and arrangement thereof are within the scope of the invention as set forth in the attached claims.

The claimed invention is:

1. A direct current (DC) remote power controller for remotely controlling DC power between a DC power source and a DC load, comprising:

a current sensor for sensing the level of current that the power source supplies to the load and generating a current feedback signal representative of the sensed current level;

a current limit controller that compares the current feedback signal to a reference current level and generates a current regulation signal representative of the value of sensed current level above the reference current level;

a current limiting device responsive to the current regulation signal to limit load current to the reference current level up to a first predetermined level of potential difference across the current limiting device;

a load resistance; and a switched-mode DC-to-DC converter in parallel with the current limiting device that senses potential difference across the current limiting device and diverts a portion of the load current from the current limiting device through the load resistance above the first predetermined level of potential difference to reduce power dissipation of the current limiting device and maintain the load current at the reference current level.

2. The remote power controller of claim 1, wherein the switched-mode DC-to-DC converter diverts a portion of the load current that increases in proportion to the increase in potential difference across the current limiting device between the first predetermined level of potential difference and a higher second predetermined level of potential difference.

3. The remote power controller of claim 2, wherein the switched-mode DC-to-DC converter diverts a fixed portion of the load current above the second predetermined level of potential difference.

4. The remote power controller of claim 2, wherein the switched-mode DC-to-DC converter changes the amount of load current that it diverts by controlling its duty cycle.

5. The remote power controller of claim 1, wherein the current limiting device comprises a semiconductor device.

6. The remote power controller of claim 1, wherein the switched-mode DC-to-DC converter comprises a step-down (Buck) converter.

7. The remote power controller of claim 6, wherein the potential difference across the load resistance due to the diverted load current remains below the potential difference across the current limiting device.

8. The remote power controller of claim 1, wherein the switched-mode DC-to-DC converter comprises a step-up (Boost) converter.

9. The remote power controller of claim 8, wherein the potential difference across the load resistance due to the diverted load current remains above the potential difference across the current limiting device.

10. The remote power controller of claim 1, wherein the switched-mode DC-to-DC converter comprises a transformer-isolated converter.

11. A direct current (DC) remote power controller for remotely controlling DC power between a DC power source and a DC load, comprising:

a current sensor for sensing the level of current that the power source supplies to the load and generating a current feedback signal representative of the sensed current level;

a current limit controller that compares the current feedback signal to a reference current level and generates a current regulation signal representative of the value of sensed current level above the reference current level;

a current limiting device that is responsive to the current regulation signal to limit load current to the reference current level up to a first predetermined level of potential difference across the current limiting device;

a load resistance; and a switched-mode DC-to-DC converter in parallel with the current limiting device that senses potential difference across the current limiting device and controls its duty cycle to divert a portion of the load current from the current limiting device through the load resistance above the first predetermined level of potential difference that increases in proportion to the increase in potential difference across the current limiting device between the first predetermined level of potential difference and a higher second predetermined level of potential difference to reduce power dissipation of the current limiting device and maintain the load current at the reference current level.

12. The remote power controller of claim 11, wherein the switched-mode DC-to-DC converter diverts a fixed portion of the load current above the second predetermined level of potential difference.

13. The remote power controller of claim 11, wherein the current limiting device comprises a semiconductor device.

14. The remote power controller of claim 11, wherein the switched-mode DC-to-DC converter comprises a step-down (Buck) converter.

15. The remote power controller of claim 14, wherein the potential difference across the load resistance due to the diverted load current remains below the potential difference across the current limiting device.

16. The remote power controller of claim 11, wherein the switched-mode DC-to-DC converter comprises a step-up (Boost) converter.

17. The remote power controller of claim 16, wherein the potential difference across the load resistance due to the diverted load current remains above the potential difference across the current limiting device.

18. The remote power controller of claim 11, wherein the switched-mode DC-to-DC converter comprises a transformer-isolated converter.

19. A direct current (DC) remote power controller for remotely controlling DC power between a DC power source and a DC load, comprising:

a current sensor for sensing the level of current that the power source supplies to the load and generating a current feedback signal representative of the sensed current level;

a current limit controller that compares the current feedback signal to a reference current level and generates a current regulation signal representative of the value of sensed current level above the reference current level;

at least one semiconductor device that is responsive to the current regulation signal to limit load current to the reference current level up to a first predetermined level of potential difference across the current limiting device;

a load resistance; and a switched-mode DC-to-DC converter in parallel with the semiconductor device that senses potential difference across the semiconductor device and controls its duty cycle to divert a portion of the load current from the semiconductor switching device through the load resistance above the first predetermined level of potential difference that increases in proportion to the increase in potential difference across the semiconductor device between the first predetermined level of potential difference and a higher second predetermined level of potential difference to reduce power dissipation of the semiconductor device and maintain the load current at the reference current level.

20. The remote power controller of claim 19, wherein the switched-mode DC-to-DC converter diverts a fixed portion of the load current above the second predetermined level of potential difference.

21. The remote power controller of claim 19, wherein the switched-mode DC-to-DC converter comprises a step-down (Buck) converter.

22. The remote power controller of claim 21, wherein the potential difference across the load resistance due to the diverted load current remains below the potential difference across the semiconductor device.

23. The remote power controller of claim 19, wherein the switched-mode DC-to-DC converter comprises a step-up (Boost) converter.

24. The remote power controller of claim 23, wherein the potential difference across the load resistance due to the diverted load current remains above the potential difference across the semiconductor switching device.

25. The remote power controller of claim 19, wherein the switched-mode DC-to-DC converter comprises a transformer-isolated converter.

* * * * *